US007552920B2

(12) United States Patent
Morinaga

(10) Patent No.: US 7,552,920 B2
(45) Date of Patent: Jun. 30, 2009

(54) PAPER FEED CASSETTE

(75) Inventor: Kenichi Morinaga, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 241 days.

(21) Appl. No.: 11/650,990

(22) Filed: Jan. 9, 2007

(65) Prior Publication Data

US 2007/0158900 A1 Jul. 12, 2007

(30) Foreign Application Priority Data

Jan. 10, 2006 (JP) ..... 2006-002374

(51) Int. Cl.
*B65H 1/00* (2006.01)

(52) U.S. Cl. ..... 271/145; 271/164

(58) Field of Classification Search ..... 271/145, 271/162, 164, 168; 399/393, 385; 225/27, 225/93, 105, 106; 24/67.3, 67.9, 67.11, 67 P; 269/161, 86, 157; 206/238, 449; 378/182, 378/187, 188; 281/45; 221/30; 396/613; 270/5.02, 5.03, 21.1, 30.08, 30.09, 52.09, 270/52.17, 58.07; 347/157; 400/621, 621.1, 400/621.2; 358/304; 101/117, 226, 227; 83/452, 453, 459, 466.1, 467.1
See application file for complete search history.

(56) References Cited

U.S. PATENT DOCUMENTS

| | | | | |
|---|---|---|---|---|
| 2,609,047 | A * | 9/1952 | Wilkoff | 83/454 |
| 4,423,975 | A * | 1/1984 | Krenz | 400/616 |
| 4,529,113 | A * | 7/1985 | Elliott | 225/1 |
| 4,657,163 | A * | 4/1987 | Cats | 225/106 |
| 4,782,986 | A * | 11/1988 | Loesche | 225/1 |
| 4,991,760 | A * | 2/1991 | Coryell | 225/106 |
| 5,357,832 | A * | 10/1994 | Ferguson | 83/423 |
| 5,533,621 | A * | 7/1996 | Schoal, Jr. | 206/409 |
| 6,029,425 | A * | 2/2000 | Dunn | 53/449 |
| 6,491,460 | B1 * | 12/2002 | Sodeyama et al. | 400/613.1 |
| 2001/0000901 | A1 * | 5/2001 | Kambouris et al. | 220/212 |

FOREIGN PATENT DOCUMENTS

JP 9-2441 A 1/1997

* cited by examiner

*Primary Examiner*—Patrick H Mackey
*Assistant Examiner*—Jeremy Severson
(74) *Attorney, Agent, or Firm*—Crowell & Moring LLP

(57) ABSTRACT

A paper feed cassette capable of obtaining a printed material without a margin portion easily while inhibiting the number of components from increase. This paper feed cassette includes a paper feed cassette body storing a paper and a cover member detachably mounted on the paper feed cassette body. The cover member is integrally formed with a press portion pressing a margin portion of the paper when the margin portion of the paper having been printed is cut off.

5 Claims, 4 Drawing Sheets

PAPER FEED CASSETTE

BACKGROUND OF THE INVENTION

1. Field of the Invention

The present invention relates to a paper feed cassette, and more particularly, it relates to a paper feed cassette comprising a cover member.

2. Description of the Background Art

A paper feed cassette detachably mounted on an image generating apparatus is known in general. This paper feed cassette stores a plurality of papers in a stacked state for consecutively feeding the same to the image generating apparatus. Each paper stored in this paper feed cassette is formed with perforations for cutting off a margin portion of the paper. The margin portion is cut off along the perforations after printing is completed, whereby a printed material such as a picture without a margin can be obtained.

Japanese Patent Laying-Open No. 9-2411 discloses a label printer comprising a label roll formed with perforations for each prescribed length and a press member for cutting a label paper fed from the label roll along the perforations, for example.

In aforementioned paper feed cassette detachably mounted on the image generating apparatus, however, when the margin portion of the paper having been printed is cut off along the perforations, a printed portion of the paper may be accidentally broken or the margin portion of the paper may partially remains due to a failure of the cut-off. In this case, it is disadvantageously difficult to obtain a printed material such as a picture without a margin portion.

A structure of the label printer disclosed in the aforementioned Japanese Patent Laying-Open No. 9-2411 can suppress a case where the label paper is accidentally broken or a case where the label paper is partially remains due to a failure of the cut-off, when the label paper is cut off along the perforations with the press member. However, the press member for cutting off the label paper along the perforations must be provided separately, and hence the number of components is disadvantageously increased.

SUMMARY OF THE INVENTION

The present invention has been proposed in order to solve the aforementioned problems, and an object of the present invention is to provide a paper feed cassette capable of obtaining a printed material without a margin portion easily while inhibiting the number of components from increase.

In order to attain the aforementioned object, a paper feed cassette according to a first aspect of the present invention comprises a paper feed cassette body storing a paper and a cover member detachably mounted on the paper feed cassette body, wherein the cover member is integrally formed with a press portion pressing a margin portion of the paper when the margin portion of the paper having been printed is cut off.

In the aforementioned paper feed cassette according to the first aspect, as hereinabove described, the cover member is integrally formed with the press portion pressing the margin portion of the paper when the margin portion of the paper having been printed is cut off. Accordingly, the paper can be bent in a state where the margin portion of the paper is pressed with the press portion, and hence the print portion of the paper can be inhibited from being disadvantageously accidentally broken, or the margin portion of the paper can be inhibited from disadvantageously partially remaining due to a failure of the cut-off. Thus, the margin portion of the paper having been printed can be easily cut off, whereby a printed material such as a picture without the margin portion can be easily obtained. The press portion is integrally formed with the cover member of the paper feed cassette, whereby the number of components can be inhibited from increase dissimilarly to a case where the press member for cutting off the margin portion of the paper is separately provided in the image generating apparatus. Consequently, a printed material such as a picture without the margin portion can be easily obtained while inhibiting the number of components from increase. The press portion is formed on the cover member detachably mounted on the paper feed cassette body, whereby the paper feed cassette body is mounted on the image generating apparatus and the margin portion of the paper having been printed can be cut off with the cover member including the press portion detached from the paper feed cassette body when printing is performed with the image generating apparatus.

In the aforementioned paper feed cassette according to the first aspect, the press portion preferably includes an elastically deformable hinge portion provided on a first side surface in a longitudinal direction of the cover member and a rotating portion so provided continuous to the hinge portion as to extend from a side of the first side surface in the longitudinal direction of the cover member to a side of a second side surface in the longitudinal direction of the cover member. According to this structure, the hinge portion is elastically deformed, whereby the rotating portion can be rotated. Thus, the margin portion of the paper can be easily pressed with the rotating portion.

In the aforementioned paper feed cassette according to the first aspect, the cover member is preferably so provided as to protrude upwardly from an upper surface of the cover member, and preferably integrally includes a first locating portion for locating an end in a longitudinal direction of the paper when the margin portion of the paper having been printed is cut off. According to this structure, the end in the longitudinal direction of the paper can be easily arranged, by the first locating portion, at a prescribed position where the margin portion of the paper is pressed with the press portion, while the number of components is inhibited from increase.

In this case, the first locating portion is preferably so provided as to extend from a side of a first side surface in a longitudinal direction of the cover member to a side of a second side surface in the longitudinal direction of the cover member. According to this structure, whereby the end in the longitudinal direction of the paper can be easily brought into contact with the first locating portion when the end in the longitudinal direction of the paper is located. Thus, the end in the longitudinal direction of the paper can be easily arranged at a prescribed position where the margin portion of the paper is pressed with the press portion.

In the aforementioned paper feed cassette according to the first aspect, the press portion of the cover member is preferably so provided as to protrude downwardly from the press portion, and preferably integrally includes a second locating portion for locating an end in a short-side direction of the paper when the margin portion of the paper having been printed is cut off. According to this structure, the end in the short-side direction of the paper can be easily arranged, by the second locating portion, at a prescribed position where the margin portion of the paper is pressed with the press portion, while the number of components is inhibited from increase.

In this case, the press portion includes an elastically deformable hinge portion provided on a first side surface in a longitudinal direction of the cover member and a rotating portion so provided continuous to the hinge portion as to extend from a side of the first side surface in the longitudinal direction of the cover member to a side of a second side surface in the longitudinal direction of the cover member, and the second locating portion is so provided as to protrude downwardly from a vicinity of a boundary portion of the hinge portion and the rotating portion. According to this structure, the paper can be inserted from the side of the second side surface in the longitudinal direction of the cover member, formed with no hinge portion, when the end in the short-side direction of the paper is located. Thus, the end in the short-side direction of the paper can be easily arranged at a prescribed position where the margin portion of the paper is pressed with the press portion.

In the aforementioned paper feed cassette according to the first aspect, the cover member preferably integrally includes a paper supporting portion for holding the margin portion of the paper between the press portion and the paper supporting portion when the margin portion of the paper having been printed is cut off, and the paper supporting portion is preferably so provided as to protrude upwardly from an upper surface of the cover member and extend in a longitudinal direction of the cover member. According to this structure, pressing force applied to the margin portion of the paper with the press portion can be easily concentrated on a region of the margin portion of the paper corresponding to the paper supporting portion, while the number of components is inhibited from increase. Thus, the margin portion of the paper can be securely fixed, and hence the print portion of the paper can be inhibited from being disadvantageously accidentally broken when the margin portion of the paper is cut off, or the margin portion of the paper can be inhibited from disadvantageously partially remaining due to a failure of the cut-off.

In the aforementioned structure in which the cover member includes the paper supporting portion, lengths of portions corresponding to a short-side direction of the paper in the press portion and the paper supporting portion are preferably larger than a length in the short-side direction of the paper. According to this structure, the paper can be bent in a state of pressing an overall length from the first side surface in the short-side direction of the paper to the second side surface in the short-side direction of the paper with the press portion and the paper supporting portion, and hence the margin portion of the paper can be easily cut off.

In the aforementioned structure in which the cover member includes the paper supporting portion, the paper supporting portion is provided on a side end in a short-side direction of the cover member. According to this structure, whereby the paper can be easily bent in a state of pressing the paper with the press portion and the paper supporting portion.

In the aforementioned paper feed cassette according to the first aspect, the paper is preferably formed with a perforation for cutting off the margin portion of the paper, and the margin portion of the paper is preferably pressed along the perforation of the paper with an edge of the press portion of the cover member. According to this structure, the paper can be easily bent along the perforation. Thus, the margin portion can be easily cut off along the perforation.

In the aforementioned structure in which the press portion includes the rotating portion and the hinge portion, the press portion is preferably so provided on a side opposite to the hinge portion of the rotating portion as to protrude upwardly, and preferably further includes a pressing portion for pressing with a finger. According to this structure, the hinge portion can be easily elastically deformed by pressing the pressing portion 12*i* with a finger. Thus, the rotating portion can be easily rotated.

A paper feed cassette according to a second aspect of the present invention comprises a paper feed cassette body storing a paper and a cover member detachably mounted on the paper feed cassette body, wherein the paper is formed with a perforation for cutting off a margin portion of the paper, the cover member integrally includes a press portion having an edge pressing the margin portion of the paper along the perforation of the paper when the margin portion of the paper having been printed is cut off, a first locating portion for locating an end in a longitudinal direction of the paper, so provided as to protrude upwardly from an upper surface of the cover member, and a paper supporting portion for holding the margin portion of the paper between the press portion and the paper supporting portion, the press portion integrally includes an elastically deformable hinge portion provided on a first side surface in a longitudinal direction of the cover member, a rotating portion so provided continuous to the hinge portion as to extend from a side of the first side surface in the longitudinal direction of the cover member to a side of a second side surface in the longitudinal direction of the cover member, and a second locating portion for locating an end in a short-side direction of the paper when the margin portion of the paper having been printed is cut off, so provided as to protrude downwardly from the press portion, the paper supporting portion is so provided as to protrude upwardly from an upper surface of the cover member and extend in the longitudinal direction of the cover member, and lengths of portions corresponding to a short-side direction of the paper in the press portion and the paper supporting portion are larger than a length in the short-side direction of the paper.

In the paper feed cassette according to the second aspect, as hereinabove described, the cover member of the paper feed cassette is formed with the press portion pressing the margin portion of the paper when the margin portion of the paper having been printed is cut off. Accordingly, the paper can be bent in a state where the margin portion of the paper is pressed with the press portion, and hence the print portion of the paper can be inhibited from being disadvantageously accidentally broken, or the margin portion of the paper can be inhibited from disadvantageously partially remaining due to a failure of the cut-off. Thus, the margin portion of the paper having been printed can be easily cut off, whereby a printed material such as a picture without the margin portion can be easily obtained. The press portion is integrally formed with the cover member of the paper feed cassette, whereby the number of components can be inhibited from increase dissimilarly to a case where the press member for cutting off the margin portion of the paper is separately provided in an image generating apparatus. Consequently, a printed material such as a picture without the margin portion can be easily obtained while inhibiting the number of components from increase. The press portion is formed on the cover member detachably mounted on the paper feed cassette body, whereby the paper feed cassette body is mounted on the image generating apparatus and the margin portion of the paper having been printed can be cut off with the cover member including the press portion detached from the paper feed cassette body when printing is performed with an image generating apparatus. The press portion includes the elastically deformable hinge portion provided on the first side surface in the longitudinal direction of the cover member and the rotating portion so provided continuous to the hinge portion as to extend from the side of the first side surface in the longitudinal direction of the cover member to the side of the second side surface in the longitudinal direction of the cover member, whereby the rotating portion can be rotated by elastically deforming the hinge portion. Thus, the margin portion of the paper can be easily pressed with the rotating portion.

According to the second aspect, the cover member is integrally provided with the first locating portion for locating the end in the longitudinal direction of the paper at the time of cutting off the margin portion of the paper having been printed so as to protrude upwardly from the upper surface of the cover member. Thus, the end in the longitudinal direction of the paper can be easily arranged, by the first locating portion, at a prescribed position where the margin portion of the paper is pressed with the press portion, while the number of components is inhibited from increase. The press portion of the cover member is integrally provided with the second locating portion for locating the end in the short-side direction of the paper at the time of cutting off the margin portion of the paper having been printed so as to protrude downwardly from the press portion. Accordingly, the end in the short-side direction of the paper can be easily arranged, by the second locating portion, at the prescribed position where the margin portion of the paper is pressed with the press portion, while the number of components is inhibited from increase. The cover member is integrally provided with the paper supporting portion for holding the margin portion of the paper between the press portion and the paper supporting portion at the time of cutting off the margin portion of the paper having been printed, so as to protrude upwardly from the upper surface of the cover member and extend in the longitudinal direction of the cover member. Accordingly, pressing force applied to the margin portion of the paper with the press portion can be easily concentrated on a region of the margin portion of the paper corresponding to the paper supporting portion, while the number of components is inhibited from increase. Thus, the margin portion of the paper can be securely fixed, and hence the print portion of the paper can be inhibited from being disadvantageously accidentally broken when the margin portion of the paper is cut off, or the margin portion of the paper can be inhibited from disadvantageously partially remaining due to a failure of the cut-off. The lengths of the portions corresponding to the short-side direction of the paper in the press portion and the paper supporting portion are preferably larger than the length in the short-side direction of the paper. Thus, the paper can be bent in a state of pressing an overall length from the first side surface in the short-side direction of the paper to the second side surface in the longitudinal direction of the cover member with the press portion and the paper supporting portion, and hence the margin portion of the paper can be reliably cut off. The paper is formed with the perforation for cutting off the margin portion of the paper, and the margin portion of the paper is pressed along the perforation of the paper with the edge of the press portion of the cover member, whereby the paper can be bent along the perforation. Thus, the margin portion can be cut off along the perforation.

In the aforementioned paper feed cassette according to the second aspect, the first locating portion is preferably so provided as to extend from the side of the first side surface in the longitudinal direction of the cover member to the side of the second side surface in the longitudinal direction of the cover member. According to this structure, it is possible to easily bring the end in the longitudinal direction of the paper into the first locating portion when the end in the longitudinal direction of the paper is located, whereby the end in the longitudinal direction of the paper can be more easily arranged at a prescribed position where the margin portion of the paper is pressed with the press portion.

In the aforementioned paper feed cassette according to the second aspect, the second locating portion is so provided as to protrude downwardly from a vicinity of a boundary portion of the hinge portion and the rotating portion. According to this structure, the paper can be inserted from the side of the second side surface in the longitudinal direction of the cover member, formed with no hinge portion, when the end in the short-side direction of the paper is located. Thus, the end in the short-side direction of the paper can be easily arranged at a prescribed position where the margin portion of the paper is pressed with the press portion.

In the aforementioned paper feed cassette according to the second aspect, the paper supporting portion is provided on a side end in a short-side direction of the cover member. According to this structure, the paper can be easily bent in a state of pressing the paper with the press portion and the paper supporting portion.

In the aforementioned paper feed cassette according to the second aspect, the press portion is preferably so provided on a side opposite to the hinge portion of the rotating portion as to protrude upwardly, and further includes a pressing portion for pressing with a finger. According to this structure, the pressing portion is pressed with a finger, whereby the hinge portion can be easily elastically deformed by pressing the pressing portion with a finger. Thus, the rotating portion can be easily rotated.

DESCRIPTION OF THE PREFERRED EMBODIMENTS

An embodiment of the present invention will be hereinafter described with reference to the drawings.

A structure of a paper feed cassette 1 according to an embodiment of the present invention will be described with reference to FIGS. 1 to 6

Figure 1:
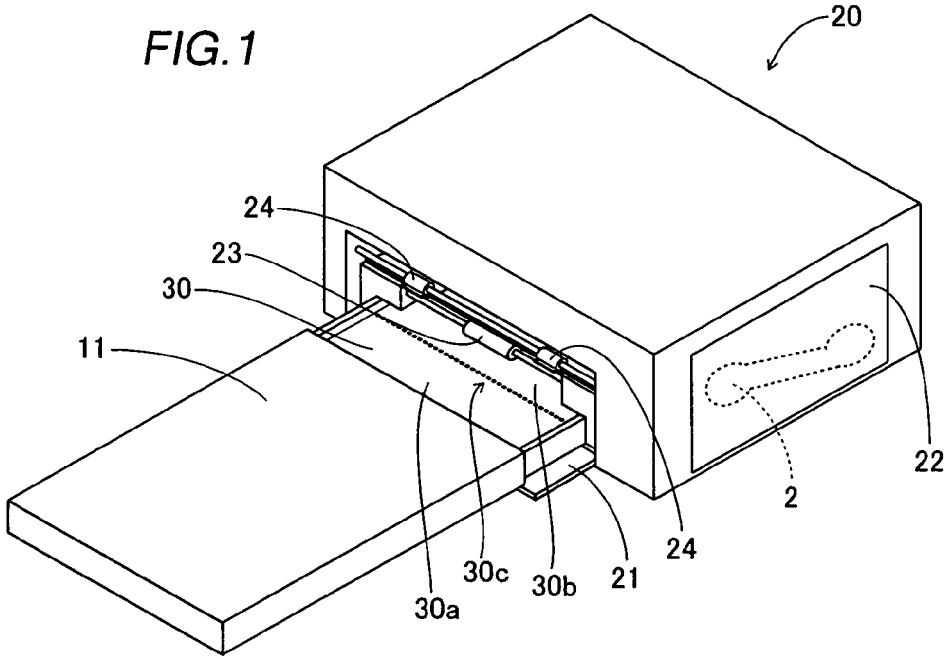
FIG. 1 is a perspective view showing a paper feed cassette body of a paper feed cassette according to an embodiment of the present invention mounted on a thermal transfer printer.
Figure 2:
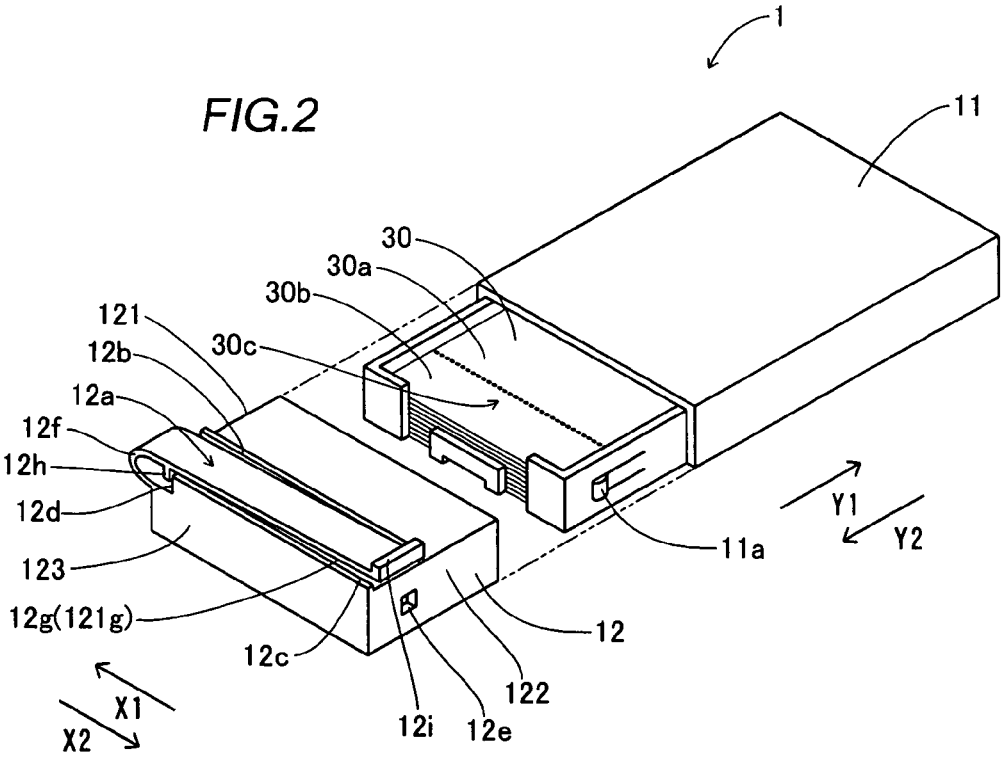
FIG. 2 is a perspective view showing an overall structure of the paper feed cassette according to the embodiment of the present invention.
Figure 3:
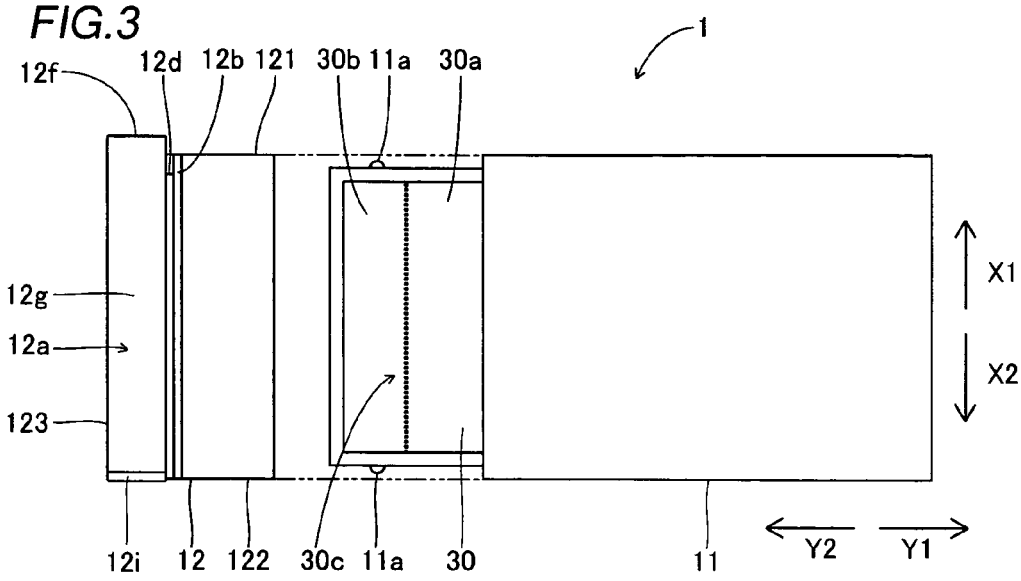
FIG. 3 is a plan view showing the over all structure of the paper feed cassette according to the embodiment shown in FIG. 2.
Figure 4:
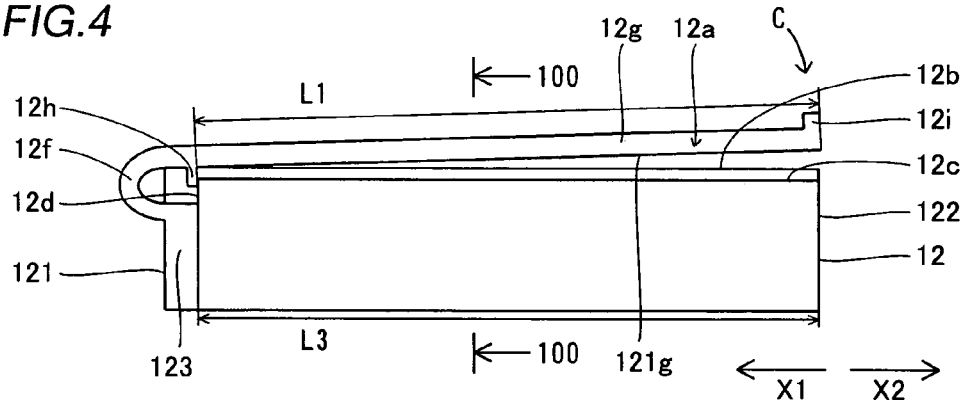
FIG. 4 is a front view showing a cover member of the paper feed cassette according to the embodiment shown in FIG. 2.
Figure 5:
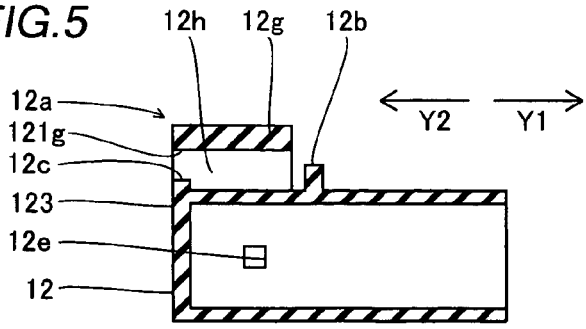
FIG. 5 is a sectional view taken along a line 100-100 in FIG. 4.

The paper feed cassette 1 according to this embodiment is made of resin such as ABS resin, and includes a paper feed cassette body 11 storing a plurality of papers 30 before printing for being fed to a thermal transfer printer 20 in a stacked state and a cover member 12 detachably mounted on the paper feed cassette body 11, as shown in FIG. 1 to 3. The paper feed cassette body 11 is formed with a pair of engaging pieces 11*a* engaged with engaging holes 12*e* of the cover member 12 and engaged with engaging holes (not shown) of the thermal transfer printer 20. The engaging pieces 11*a* are provided for mounting the cover member 12 on the paper feed cassette body 11 by engaging the engaging pieces 11*a* with the engaging holes 12*e* of the cover member 12 and for mounting the paper feed cassette body 11 on the thermal transfer printer 20 by engaging the engaging pieces 11*a* with the engaging holes (not shown) of the thermal transfer printer 20.

According to this embodiment, the cover member 12 includes a press portion 12*a*, a locating portion 12*b*, a paper supporting portion 12*c*, a step portion 12*d* and the aforementioned engaging holes 12*e*, as shown in FIGS. 2 to 5. The cover member 12 has a function of covering the papers 30 stored in the paper feed cassette body 11 by being mounted on the paper feed cassette body 11. Thus, foreign matter such as dust can be inhibited from penetrating inside the paper feed cassette body 11. The locating portion 12*b* is an example of the "first locating portion" in the present invention.

According to this embodiment, the press portion 12*a* is integrally formed with the cover member 12 made of resin such as ABS resin and is constituted by a hinge portion 12*f*, a rotating portion 12*g*, a locating portion 12*h* and a pressing portion 12*i*, as shown in FIGS. 2 to 6. The hinge portion 12*f* of the press portion 12*a* has a thickness of about 1.5 mm and is formed in a U-shape protruding laterally from a first side surface 121 of the cover member 12. The hinge portion 12*f* is so formed to as to be elastically deformable. The rotating portion 12*g* of the press portion 12*a* is integrally coupled to the hinge portion 12*f* and is so formed as to extend in a plate shape from a side of the first side surface 121 to a side of the second side surface 122 in a longitudinal direction (along arrow X1 and arrow X2) of the cover member 12. Thus, the rotating portion 12*g* integrally coupled to the hinge portion 12*f* can be rotated along arrow C (see FIG. 4) about the hinge portion 12*f*. The rotating portion 12*g* has a thickness of about 2 mm and rotates along arrow C (see FIG. 4), whereby an edge 121*g* (FIG. 5) of the rotating portion 12*g* has a function of pressing the paper 30 against the paper supporting portion 12*c* of the cover member 12. A length L1 (see FIG. 4) in a longitudinal direction of the rotating portion 12*g* is so formed as to be larger than a length L2 (see FIG. 6) in a short-side direction (along arrow X1 and arrow X2) of the paper 30. The locating portion 12*h* of the press portion 12*a* is so formed as to protrude downwardly from a vicinity of a boundary portion of the hinge portion 12*f* and the rotating portion 12*g*. The locating portion 12*h* is provided for locating the paper 30 by bringing an end 31 in a short-side direction (along arrow X1 and arrow X2) of the paper 30 into contact with the locating portion 12*h* when the paper 30 is arranged between the rotating portion 12*g* and the paper supporting portion 12*c*. The pressing portion 12*i* of the press portion 12*a* is so formed on a side opposite to the hinge portion 12*f* of the rotating portion 12*g* as to protrude upwardly. The pressing portion 12*i* is provided for pressing with a finger at a time of rotating the rotating portion 12*g* along arrow C (see FIG. 4). The locating portion 12*h* is an example of the "second locating portion" in the present invention.

According to this embodiment, the locating portion 12*b* of the cover member 12 is formed in a rib-shape so as to protrude upwardly from an upper surface of the cover member 12 and to extend from the side of the first side surface 121 to the side of the second side surface 122 in the longitudinal direction (along arrow X1 and arrow X2) of the cover member 12, as shown in FIGS. 2 to 6. The locating portion 12*b* is provided for locating the paper 30 by bringing an end 32 in a longitudinal direction (along arrow Y1 and arrow Y2) of the paper 30 into contact with the locating portion 12*b* when the paper 30 is arranged between the rotating portion 12*g* of the press portion 12*a* and the paper supporting portion 12*c*. A position in the longitudinal direction (along arrow Y1 and arrow Y2) of the paper 30 determined by the locating portion 12*b* is formed such that a vicinity of perforations 30*c* (see FIG. 6) of a margin portion 30*b* of the paper 30 is held between the edge 121*g* of the rotating portion 12*g* and the paper supporting portion 12*c* at a time of holding the paper 30 between the edge 121*g* of the rotating portion 12*g* and the paper supporting portion 12*c*. The paper supporting portion 12*c* of the cover member 12 protrudes upwardly from the upper surface of the cover member 12 and is so formed on a side end 123 in the short-side direction (along arrow Y2) of the cover member 12 as to extend in the longitudinal direction (along arrow X1 and arrow X2) of the cover member 12. The paper supporting portion 12*c* is so provided as to support the paper 30 pressed with the rotating portion 12*g* of the press portion 12*a*. A length L3 (see FIG. 6) in a longitudinal direction (along arrow X1 and arrow X2) of the paper supporting portion 12*c* is so formed as to be larger than the length L2 (see FIG. 6) in the short-side direction (along arrow X1 and arrow X2) of the paper 30. The step portion 12*d* of the cover member 12 is so provided for arranging the locating portion 12*h* of the press portion 12*a*.

The thermal transfer printer 20 includes opening/closing members 21 and 22, a paper feed roller 23 and paper discharge rollers 24 as shown in FIG. 1. The opening/closing members 21 and 22 are provided rotatably toward outside of the thermal transfer printer 20 about lower ends respectively. The opening/closing member 21 is opened, whereby an inside of the thermal transfer printer 20 is exposed and the paper feed cassette body 11 of the paper feed cassette 1 can be mounted on the thermal transfer printer 20. In a state where the paper feed cassette body 11 of the paper feed cassette 1 is detached, the opening/closing member 21 is closed, whereby dust or the like is inhibited from penetrating inside the thermal transfer printer 20. The opening/closing member 22 is opened, whereby the inside of the thermal transfer printer 20 is exposed and an ink sheet cartridge 2 can be mounted on the thermal transfer printer 20. The opening/closing member 22 is closed except when the ink sheet cartridge 2 is mounted or detached, whereby dust or the like is inhibited from penetrating inside the thermal transfer printer 20. The paper feed roller 23 has a function of feeding the papers 30 stored in the paper feed cassette body 11 mounted on the thermal transfer printer 20 one by one to the inside of the thermal transfer printer 20 by being rotated with a motor (not shown). The paper discharge rollers 24 have a function of discharging the paper 30 having been printed inside the thermal transfer printer 20 to the outside of the thermal transfer printer 20 by being rotated with a motor (not shown).

Figure 6:
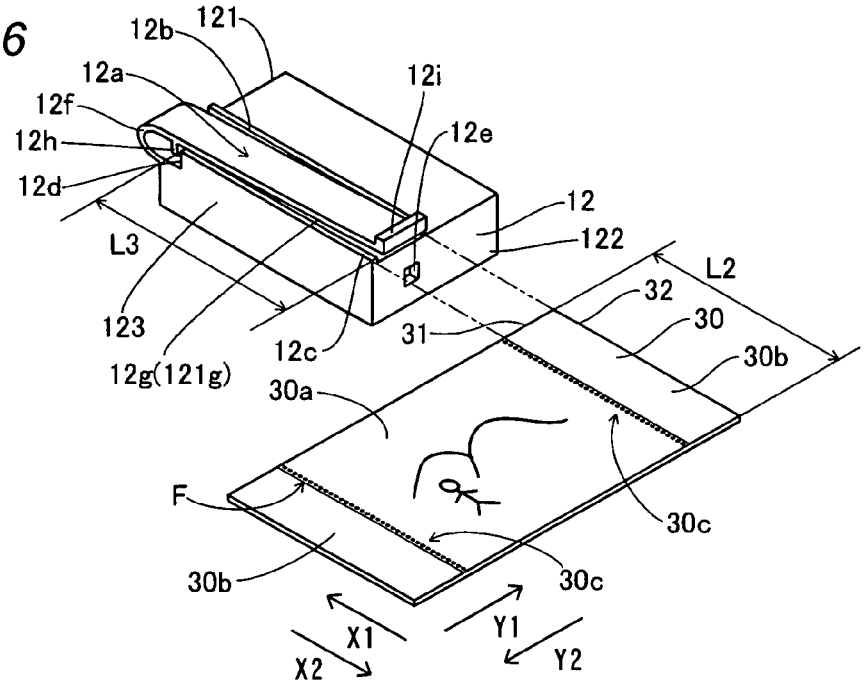
FIG. 6 is a perspective view showing the cover member of the paper feed cassette according to the embodiment shown in FIG. 2 and a paper.

According to this embodiment, the paper 30 has a thickness of about 0.3 mm and includes a print portion 30*a* and the margin portions 30*b* as shown in FIG. 6. A plurality of the perforations 30*c* are formed along arrow X1 (along arrow X2) at prescribed intervals along a boundary portion of the print portion 30*a* and each margin portion 30*b* of the paper 30. The paper 30 is so formed as to obtain a printed material such as a picture without the margin portions 30*b* (print portion 30*a*) by cutting off the margin portions 30*b* along the perforations 30*c*. The margin portions 30*b* of the paper 30 are provided for being supported when an image is printed in a print region F (see FIG. 6) of the paper 30 with the thermal transfer printer 20.

An operation when each margin portion 30*b* of the paper 30 is cut off by using the cover member 12 of the paper feed cassette 1 according to this embodiment will be now described with reference to FIGS. 6 to 11.

Figure 7:
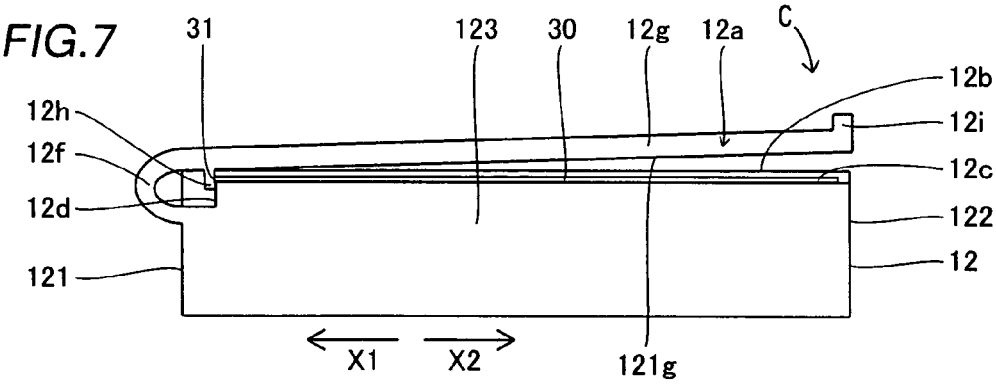
FIGS. 7 and 8 are front views for illustrating an operation of cutting off a margin portion of the paper using the cover member of the paper feed cassette according to the embodiment shown in FIG. 2.
Figure 8:
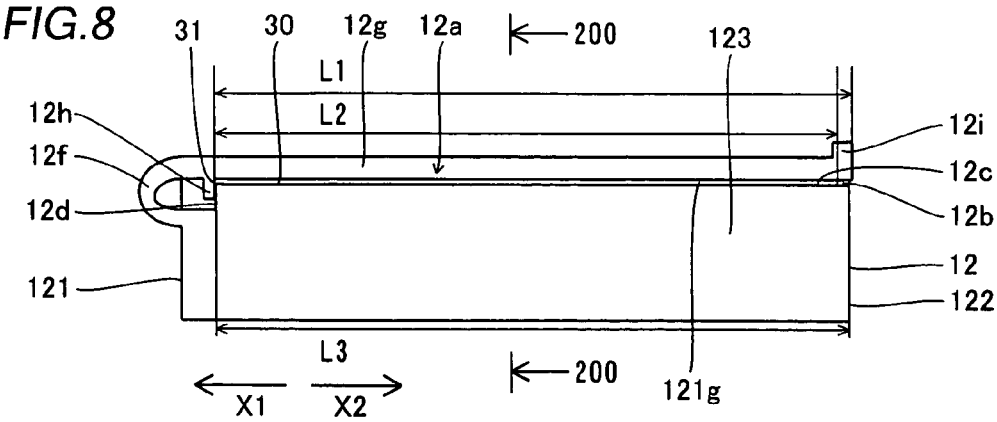
Figure 9:
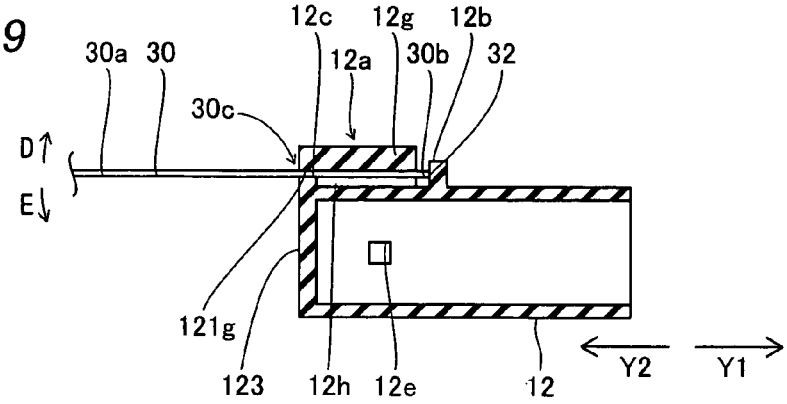
FIG. 9 is a sectional view taken along a line 200-200 in FIG. 8.
Figure 10:
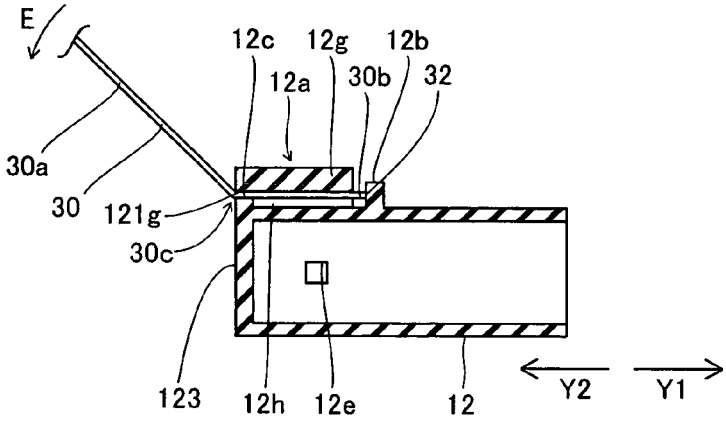
FIGS. 10 and 11 are sectional views for illustrating the operation of cutting off the margin portion of the paper using the cover member of the paper feed cassette according to the embodiment shown in FIG. 2.
Figure 11:
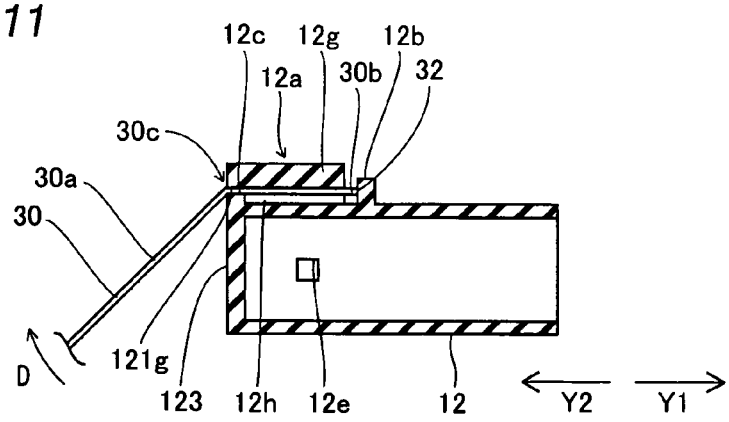

The first end 31 in the short-side direction (along arrow X1 and arrow X2) of the paper 30 is inserted between the press portion 12*a* and the paper supporting portion 12*c* of the cover member 12 along arrow X1 until the first end 31 comes into contact with the locating portion 12*h* of the cover member 12, as shown in FIG. 6. The first end 32 in the longitudinal direction (along arrow Y1 and arrow Y2) of the paper 30 is moved along arrow Y1 until the first end 32 comes into contact with the locating portion 12*b* of the cover member 12 in a state where the paper 30 is in contact with the locating portion 12*h*. The pressing portion 12*i* of the press portion 12*a* is pressed along arrow C with a finger in a state where the paper 30 is arranged at a prescribed position between the press portion 12*a* and the paper supporting portion 12*c*, as shown in FIG. 7. Thus, the hinge portion 12*f* of the press portion 12*a* is elastically deformed, whereby the rotating portion 12*g* of the press portion 12*a* is rotated along arrow C and the paper 30 is held between the edge 121*g* of the rotating portion 12*g* and the paper supporting portion 12*c*, as shown in FIG. 8. At this time, a portion held between the edge 121*g* of the rotating portion 12*g* and the paper supporting portion 12*c* corresponds to the vicinity of the perforations 30*c* of the margin portion 30*b* of the paper 30. The paper 30 is bent along arrows D and E at several times as shown in FIGS. 10 and 11 in a state where the paper 30 is held between the edge 121*g* of the rotating portion 12*g* and the paper supporting portion 12*c* as shown in FIGS. 8 and 9. Thus, the print portion 30*a* is cut off from the margin portion 30*b* of the paper 30.

According to this embodiment, as hereinabove described, when the margin portion 30*b* of the paper 30 having been printed is cut off, the press portion 12*a* pressing the margin portion 30*b* of the paper 30 is provided on the cover member 12 of the paper feed cassette 1. Accordingly, the paper 30 can be bent in a state where the margin portion 30*b* of the paper 30 is pressed with the press portion 12*a*, and hence the print portion 30*a* of the paper 30 can be inhibited from being disadvantageously accidentally broken, or the margin portion 30*b* of the paper 30 can be inhibited from disadvantageously partially remaining due to a failure of the cut-off. Thus, the margin portion 30*b* of the paper 30 having been printed can be easily cut off, whereby a printed material such as a picture without the margin portions 30*b* (print portion 30*a*) can be easily obtained. The press portion 12*a* is integrally formed with the cover member 12 of the paper feed cassette 1, whereby the number of components can be inhibited from increase dissimilarly to a case where the press member for cutting off the margin portion of the paper is separately provided in the thermal transfer printer. Consequently, a printed material such as a picture without the margin portions 30*b* (print portion 30*a*) can be easily obtained while inhibiting the number of components from increase. The press portion 12*a* is formed on the cover member 12 detachably mounted on the paper feed cassette body 11, whereby the paper feed cassette body 11 is mounted on the thermal transfer printer 20 and the margin portions 30*b* of the paper 30 having been printed can be cut off with the cover member 12 including the press portion 12*a* detached from the paper feed cassette body 11 when printing is performed with the thermal transfer printer 20.

According to this embodiment, the press portion 12*a* is so formed as to include the elastically deformable hinge portion 12*f* provided on the first side surface 121 in the longitudinal direction (along arrow X1 and arrow X2) of the cover member 12 and the plate-like rotating portion 12*g* so provided continuous to the hinge portion 12*f* as to extend from the side of the first side surface 121 to the side of the second side surface 122 in the longitudinal direction of the cover member 12. Accordingly, the hinge portion 12*f* is elastically deformed, whereby the rotating portion 12*g* can be rotated. Thus, the margin portion 30*b* of the paper 30 can be easily pressed with the rotating portion 12*g*.

According to this embodiment, when the margin portion 30*b* of the paper 30 having been printed is cut off, the locating portion 12*b* for locating the end 32 in the longitudinal direction (along arrow Y1 and arrow Y2) of the paper 30 is integrally provided with the cover member 12 so as to protrude upwardly from the upper surface of the cover member 12. Thus, the end 32 in the longitudinal direction (along arrow Y1 and arrow Y2) of the paper 30 can be easily arranged, by the locating portion 12*b*, at a prescribed position where the margin portion 30*b* of the paper 30 is pressed with the press portion 12*a*, while the number of components is inhibited from increase.

According to this embodiment, the locating portion 12*b* is so formed as to extend from the side of the first side surface 121 to the side of the second side surface 122 of the cover member 12, whereby the end 32 in the longitudinal direction (along arrow Y1 and arrow Y2) of the paper 30 can be easily brought into contact with the locating portion 12*b* when the end 32 in the longitudinal direction (along arrow Y1 and arrow Y2) of the paper 30 is located. Thus, the end 32 in the longitudinal direction (along arrow Y1 and arrow Y2) of the paper 30 can be easily arranged at the prescribed position where the margin portion 30*b* of the paper 30 is pressed with the press portion 12*a*.

According to this embodiment, when the margin portion 30*b* of the paper 30 having been printed is cut off, the locating portion 12*h* for locating the end 31 in the short-side direction (along arrow X1 and arrow X2) of the paper 30 is integrally provided with the press portion 12*a* of the cover member 12 so as to protrude downwardly from the press portion 12*a*. Thus, the end 31 in the short-side direction (along arrow X1 and arrow X2) of the paper 30 can be easily arranged, by the locating portion 12*h*, at the prescribed position where the margin portion 30*b* of the paper 30 is pressed with the press portion 12*a*, while the number of components is inhibited from increase.

According to this embodiment, the locating portion 12*h* is so provided as to protrude downwardly from the vicinity of a boundary portion of the hinge portion 12*f* and the rotating portion 12*g*, whereby the paper 30 can be inserted from the side of the second side surface 122 in the longitudinal direction (along arrow X2) of the cover member 12, formed with no hinge portion 12*f*, when the end 31 in the short-side direction (along arrow X1 and arrow X2) of the paper 30 is located. Thus, the end 31 in the short-side direction (along arrow X1 and arrow X2) of the paper 30 can be easily arranged at the prescribed position where the margin portion 30*b* of the paper 30 is pressed with the press portion 12*a*.

According to this embodiment, the paper supporting portion 12*c* for holding the margin portion 30*b* of the paper 30 between the press portion 12*a* and the paper supporting portion 12*c* is integrally provided with the cover member 12 so as to protrude upwardly from the upper surface of the cover member 12 and extend in the longitudinal direction (along arrow X1 and arrow X2) of the cover member 12 when the margin portion 30*b* of the paper 30 having been printed is cut off. Accordingly, pressing force applied to the margin portion 30*b* of the paper 30 with the press portion 12*a* can be easily concentrated on a region of the margin portion 30*b* of the paper 30 corresponding-to the paper supporting portion 12*c*, while the number of components is inhibited from increase. Thus, the margin portion 30*b* of the paper 30 can be securely fixed, and hence the print portion 30*a* of the paper 30 can be inhibited from being disadvantageously accidentally broken when the margin portion 30*b* of the paper 30 is cut off, or the margin portion 30*b* of the paper 30 can be inhibited from disadvantageously partially remaining due to a failure of the cut-off.

According to this embodiment, the lengths of portions corresponding to the short-side direction (along arrow X1 and arrow X2) of the paper 30 in the rotating portion 12*g* and the paper supporting portion 12*c* are rendered larger than the length in the short-side direction (along arrow X1 and arrow X2) of the paper 30. Thus, the paper 30 can be bent in a state of pressing an overall length from the first side surface to the second side surface in the short-side direction (along arrow X1 and arrow X2) of the paper 30 with the press portion 12*a* and the paper supporting portion 12*c*, and hence the margin portion 30*b* of the paper 30 can be reliably cut off.

According to this embodiment, the paper supporting portion 12*c* is provided on the side end 123 in the short-side direction (along arrow Y2) of the cover member 12, whereby the paper 30 can be easily bent in a state of pressing the paper 30 with the press portion 12*a* and the paper supporting portion 12*c*.

According to this embodiment, the paper 30 is formed with the perforations 30*c* for cutting off the margin portion 30*b* of the paper 30 and the margin portion 30*b* of the paper 30 is pressed along the perforations 30*c* of the paper 30 with the edge 121*g* of the press portion 12*a* of the cover member 12, whereby the paper 30 can be easily bent along the perforations 30*c*. Thus, the margin portion 30*b* can be easily cut off along the perforations 30*c*.

According to this embodiment, the press portion 12*a* is provided on the side opposite to the hinge portion 12*f* of the rotating portion 12*g* with the pressing portion 12*i* for pressing with a finger, so provided as to protrude upwardly, whereby the hinge portion 12*f* can be easily elastically deformed by pressing the pressing portion 12*i* with a finger. Thus, the rotating portion 12*g* can be easily rotated.

Although the present invention has been described and illustrated in detail, it is clearly understood that the same is by way of illustration and example only and is not to be taken by way of limitation, the spirit and scope of the present invention being limited only by the terms of the appended claims.

For example, while the aforementioned embodiment is applied to the paper feed cassette mounted on the thermal transfer printer, the present invention is not restricted to this but is also applicable to another paper feed cassette mounted on an image generating apparatus other than the thermal transfer printer.

While the locating portion 12*b* for locating the end 32 in the longitudinal direction of the paper 30 is so formed as to protrude above the upper surface of the cover member 12 and extend from the side of the first side surface 121 to the side of the second side surface 122 of the cover member 12 in the aforementioned embodiment, the present invention is not restricted to this but, the locating portion for locating the end in the longitudinal direction of the paper may be alternatively constituted by a plurality of protrusions protruding above the upper surface of the cover member.

While the locating portion 12*h* for locating the end 31 in the short-side direction of the paper 30 is so formed as to protrude below the press portion 12*a* in the aforementioned embodiment, the present invention is not restricted to this but, the locating portion for locating the end in the short-side direction of the paper may be alternatively formed so as to protrude forward from the locating portion for locating the end in the longitudinal direction of the paper, provided on the cover member.

What is claimed is:

1. A paper feed cassette comprising:

a paper feed cassette body storing a paper; and a cover member detachably mounted on said paper feed cassette body, wherein said paper is formed with a perforation for cutting off a margin portion of said paper, said cover member integrally includes a press portion having an edge pressing said margin portion of said paper along said perforation of said paper when said margin portion of said paper having been printed is cut off, a first locating portion for locating an end in a longitudinal direction of said paper, so provided as to protrude upwardly from an upper surface of said cover member, and a paper supporting portion for holding said margin portion of said paper between said press portion and said paper supporting portion, said press portion integrally includes an elastically deformable hinge portion provided on a first side surface in a longitudinal direction of said cover member, a rotating portion so provided continuous to said hinge portion as to extend from a side of said first side surface in said longitudinal direction of said cover member to a side of a second side surface in said longitudinal direction of said cover member, and a second locating portion for locating an end in a short-side direction of said paper when said margin portion of said paper having been printed is cut off, so provided as to protrude downwardly from said press portion, said paper supporting portion is so provided as to protrude upwardly from an upper surface of said cover member and extend in said longitudinal direction of said cover member, and lengths of portions corresponding to a short-side direction of said paper in said press portion and said paper supporting portion are larger than a length in said short-side direction of said paper.

2. The paper feed cassette according to claim 1, wherein said first locating portion is so provided as to extend from said side of said first side surface in said longitudinal direction of said cover member to said side of said second side surface in said longitudinal direction of said cover member.

3. The paper feed cassette according to claim 1, wherein said second locating portion is so provided as to protrude downwardly from a vicinity of a boundary portion of said hinge portion and said rotating portion.

4. The paper feed cassette according to claim 1, wherein said paper supporting portion is provided on a side end in a short-side direction of said cover member.

5. The paper feed cassette according to claim 1, wherein said press portion is so provided on a side opposite to said hinge portion of said rotating portion as to protrude upwardly, and further includes a pressing portion for pressing with a finger.

* * * * *